US007403163B2

(12) United States Patent
Kyowski

(10) Patent No.: US 7,403,163 B2
(45) Date of Patent: Jul. 22, 2008

(54) LOW PROFILE ANTENNA INSERT NUT

(75) Inventor: Timothy H. Kyowski, Brantford (CA)

(73) Assignee: Research In Motion Limited, Waterloo (CA)

( * ) Notice: Subject to any disclaimer, the term of this patent is extended or adjusted under 35 U.S.C. 154(b) by 0 days.

(21) Appl. No.: 11/671,211

(22) Filed: Feb. 5, 2007

(65) Prior Publication Data

US 2007/0126646 A1 Jun. 7, 2007

Related U.S. Application Data

(63) Continuation of application No. 11/107,974, filed on Apr. 18, 2005, now Pat. No. 7,190,314, which is a continuation of application No. 10/723,839, filed on Nov. 26, 2003, now abandoned.

(51) Int. Cl.
*H01Q 1/24* (2006.01)
*H01Q 1/50* (2006.01)

(52) U.S. Cl. ..... 343/702; 343/906; 439/916

(58) Field of Classification Search ..... 343/702, 343/715, 878, 906; 439/916
See application file for complete search history.

(56) References Cited

U.S. PATENT DOCUMENTS

| | | | | |
|---|---|---|---|---|
| 3,876,277 | A | 4/1975 | Colwell | |
| 5,158,483 | A | 10/1992 | Fishman et al. | |
| 5,714,963 | A | 2/1998 | Cox | |
| 5,936,581 | A | 8/1999 | Roshitsh et al. | |
| 5,955,999 | A | 9/1999 | Mutz et al. | |
| 5,973,645 | A | 10/1999 | Zigler et al. | |
| 6,034,639 | A | 3/2000 | Rawlins et al. | |
| 6,133,885 | A | 10/2000 | Luniak et al. | |
| 6,157,350 | A | 12/2000 | House et al. | |
| 6,300,911 | B1 | 10/2001 | Murray et al. | |
| 6,509,878 | B1 | 1/2003 | Tornatta, Jr. et al. | |
| 6,639,561 | B2 | 10/2003 | Pruss et al. | |
| 6,710,747 | B1 | 3/2004 | Chang | |
| 6,791,501 | B2 * | 9/2004 | Otsuka et al. | 343/715 |
| 6,930,643 | B2 | 8/2005 | Byrne et al. | |
| 2002/0070903 | A1 | 6/2002 | Nakamura et al. | |
| 2002/0101380 | A1 | 8/2002 | Pruss et al. | |
| 2005/0093755 | A1 | 5/2005 | Byrne et al. | |
| 2006/0077112 | A1 * | 4/2006 | Nakano et al. | 343/715 |

FOREIGN PATENT DOCUMENTS

| | | |
|---|---|---|
| EP | 0800226 | 10/1997 |
| JP | 2000-114835 | 4/2000 |
| WO | 0171844 | 9/2001 |
| WO | 02054539 | 7/2002 |

* cited by examiner

*Primary Examiner*—Tan Ho
(74) *Attorney, Agent, or Firm*—Moffat & Co.

(57) ABSTRACT

An antenna mount comprising a front cylindrical mount, the front cylindrical mount having a threaded interior for installing an antenna; a flanged central portion; a base mount consisting of a hollow cylinder cut away along a longitudinal axis, leaving a half-circular cross section. The antenna mount can be installed by inserting it into an opening in the casing of a device and rotating the antenna mount until it abuts a stop stud.

9 Claims, 2 Drawing Sheets

LOW PROFILE ANTENNA INSERT NUT

RELATED APPLICATIONS

The present application claims priority from Canadian application No. 2413459, entitled "Low Profile Antenna Insert Nut" filed Nov. 29$^{th}$, 2002. The full disclosure, including the drawings, of Canadian application No. 2413459 is incorporated herein by reference.

The present application also claims priority from U.S. provisional application Ser. No. 60/430078, entitled "Low Profile Antenna Insert Nut" filed Dec. 2$^{th}$, 2002. The full disclosure, including the drawings, of U.S. provisional application Ser. No. 60/430078 is incorporated herein by reference.

This application is a continuation of U.S. application Ser. No. 11/107,974, filed Apr. 18, 2005, which is a continuation of U.S. application Ser. No. 10/723,839, filed Nov. 26, 2003.

FIELD OF THE INVENTION

The present invention relates to mounting fixtures for antennas, and specifically to mounting fixtures for antennas on devices that have significant space restrictions

BACKGROUND TO THE INVENTION

Devices such as cellular telephones or personal digital assistants (PDAs), which will sometimes be collectively referred to as "mobile devices" in the following description, have extreme space restrictions for internal components. Significant design efforts are used to ensure the devices are as small as possible.

One of the larger components within such a device is the antenna mount. Antennas need to be screwed into these mounts, which are installed within the device. However, currently these antenna mounts have large rectangular cross section dimensions at the base end of the mount, creating the need for a significant bulge in the casing to accommodate the mount, or for significant space to be set aside within the device itself.

Another problem with current mounts is then installation. Due to the rectangular or square cross-sectional shape of current mounts, installing them requires sufficient space within the casing to slide the mounts into place. Thus installation process itself also requires more availability of space in the casing.

SUMMARY OF THE INVENTION

The present invention overcomes the disadvantages of the prior art by providing an antenna mount having a circular base portion, of which half is cut away. This configuration provides advantages for both space utilization and installation.

The half circular base of the present invention allows the corner of a circuit board to lie within the space that would otherwise be occupied by the cut-away section, thus allowing the use of a larger circuit board or a smaller casing.

Installation of the present antenna mount is further enhanced by allowing the mount to be inserted with the half circular base positioned inside the casing. The mount can then be rotated 180 degrees to abut mounting studs within the mobile device's housing, the mounting studs holding the antenna mount in place and preventing further rotation. The antenna is then screwed into the mount in a direction in which the antenna mount is forced against the mounting stud which allows the antenna to be fully tightened into the mount.

DETAILED DESCRIPTION OF THE DRAWINGS

Figure 1:
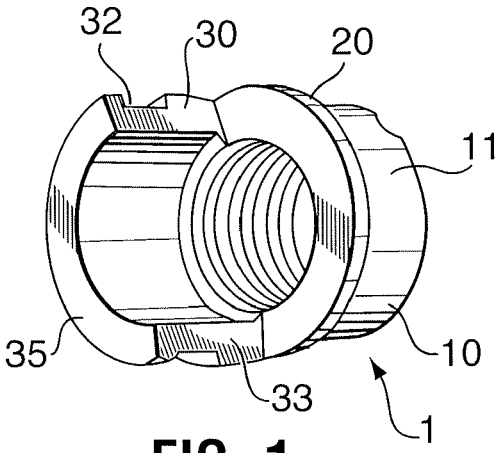
FIG. 1 is a top perspective view of the antenna mount of the present invention.
Figure 2:
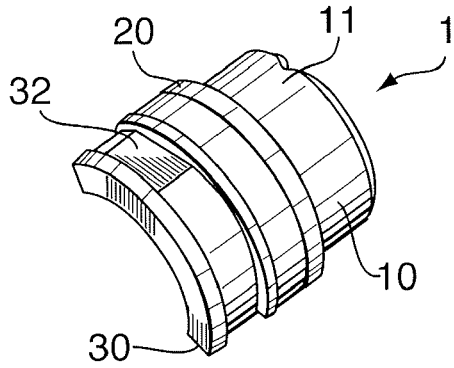
FIG. 2 is a rear perspective view of the antenna mount of FIG. 1.
Figure 3:
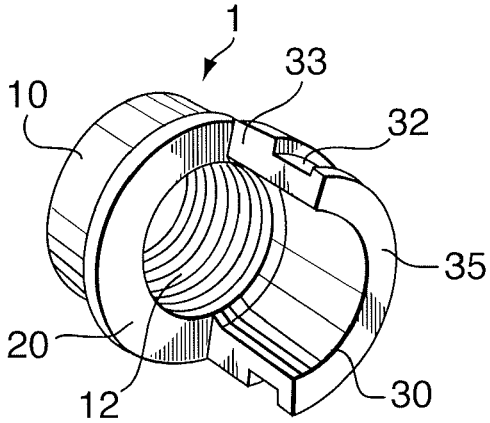
FIG. 3 is a front perspective view of the antenna mount of FIG. 1.
Figure 4:
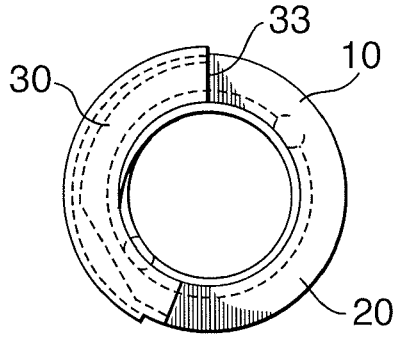
FIG. 4 is a top plan view of the antenna mount of FIG. 1.
Figure 5:
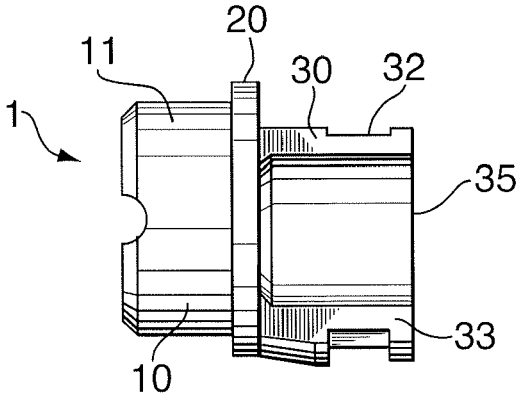
FIG. 5 is a side elevational view of the antenna mount of FIG. 1.
Figure 6:
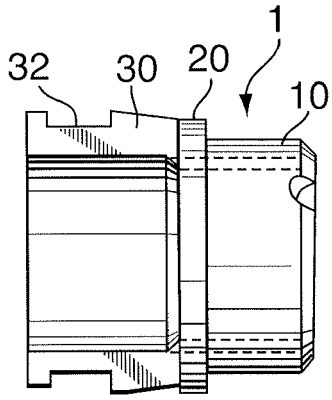
FIG. 6 is a cross-sectional view of the antenna mount of FIG. 1.

Reference is now made to the drawings. FIGS. 1 to 6 illustrate antenna mount 1. Antenna mount 1 consists of a front mount 10, a flange 20, and a base mount 30, each of which is described below.

Front mount 10 is generally cylindrical in shape having a smooth outer surface 11 and an internally threaded bore 12. Outer surface 11 is sized and dimensioned for slidable insertion into an aperture 52 formed in a casing 50 for the mobile device as seen most clearly in FIGS. 7 and 8. Following insertion, the mount is free to rotate within aperture 52.

Flange 20 located between front mount 10 and rear mount 30 is larger in diameter than the front mount to bear against the casing around aperture 52, which limits the mount's insertion into the aperture and prevents its extrusion from the casing.

The threaded bore 12 of the front mount 10 is for connection to the mobile device's correspondingly threaded antenna (not shown).

Base mount 30 is an arced projection, preferably half cylindrical, extending rearwardly from flange 20 and includes a circumferentially extending groove 32 to accommodate antenna contact clip 34 which is used to ensure electrical contact between the antenna and the mobile device's PCB (not shown).

As will be appreciated by one skilled in the art, antenna mount 1 can be manufactured by either casting or machining.

Figure 7:
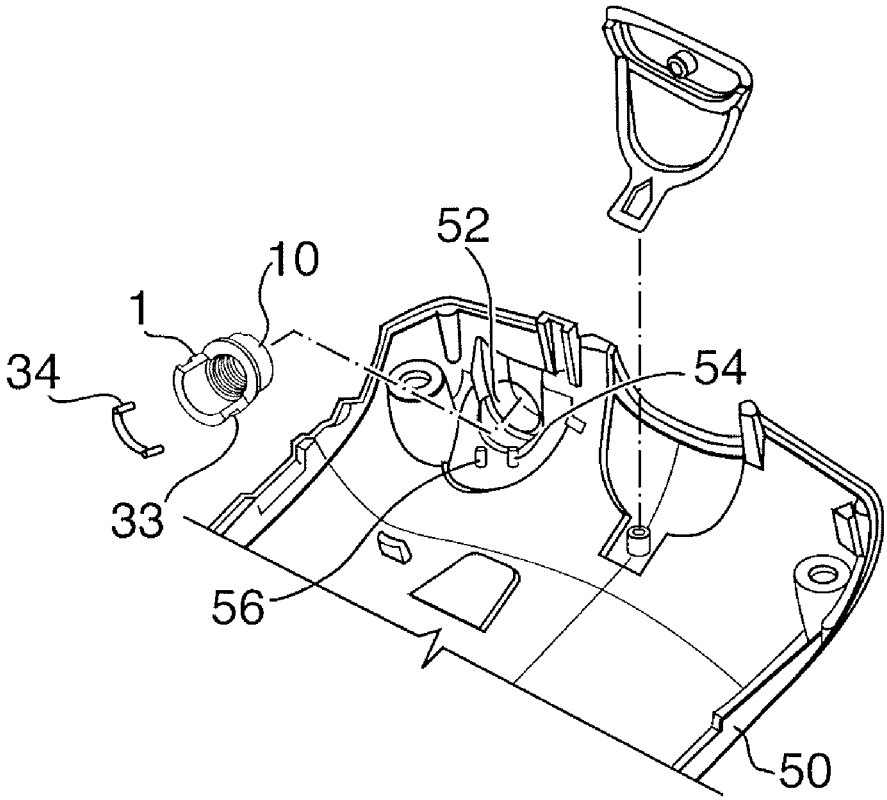
FIG. 7 is a perspective view of the casing of a portion of a casing for a mobile device adapted for use with the mount of FIG. 1.
Figure 8:
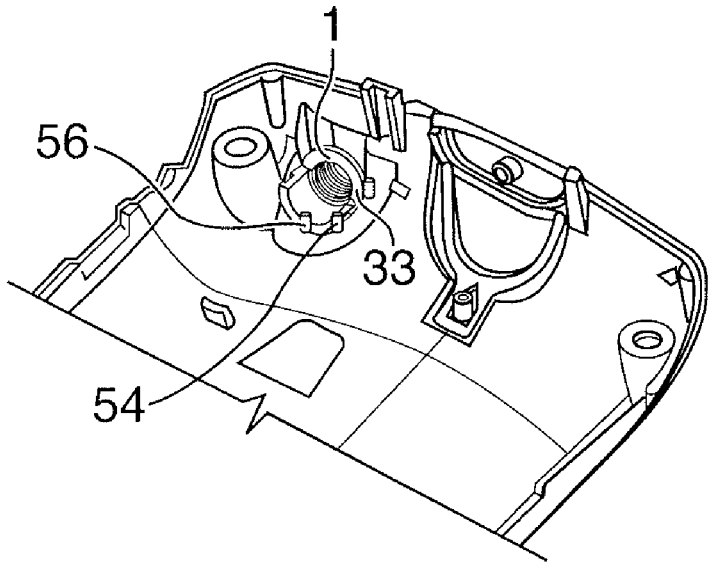
FIG. 8 is a perspective view of the casing of FIG. 7 with the antenna mount installed.

Reference is now made to FIGS. 7 and 8. To install antenna mount 1, the mount is positioned for insertion of front mount 10 into hole 52. Base mount 30 is rotated into a position that allows it to clear studs 54 and 56 located inwardly of aperture 52 as mount 1 is inserted into the aperture to the extent permitted by flange 20.

Antenna mount 1 is then rotated until edge 33 of base mount 30 abuts stud 54. Stud 54 prevents base mount 30 from rotating further. A stud 56 located slightly more inwardly relative to aperture 52 is positioned to bear against the end 35 of base mount 30. Stud 56 prevents antenna mount 1 from moving rearwards into the casing.

The present invention allows a printed circuit board to be installed so that its corner is situated over the cut away portion of base mount 30. This provides the advantage that a smaller casing or a larger circuit board can be used.

The rotation of antenna mount 1, which is metal and conductive, also rotates contact clip 34 to make electrical contact at a terminal (not shown) on the mobile device's printed circuit board.

As aforesaid, an antenna is installed by screwing it into threaded bore 12. The direction of rotation for installing the antenna biases edge 33 of base portion 30 against stud 54, such that antenna mount 1 is prevented from rotating by stud 54 which allows the antenna to be tightly screwed into the mount.

Once the device is fully assembled, the removal of antenna mount 1 is prevented by contact clip 34. Contact clip 34 makes contact with the printed circuit board, thus preventing rotation of antenna mount 1 if the antenna is unscrewed.

The advantage of the present antenna mount is therefore the savings of space in both the x and z axes, and further the ease of installation of the mount.

The above-described embodiments of the present invention are meant to be illustrative of preferred embodiments and are not intended to limit the scope of the present invention. Also, various modifications, which would be readily apparent to one skilled in the art, are intended to be within the scope of the present invention. The only limitations to the scope of the present invention are set forth in the following claims appended hereto.

The invention claimed is:

1. A method for installing an low profile antenna insert nut into a compact device having a device casing, the low profile antenna insert nut having a cylindrical front mount with a round outer surface, a flanged central portion disposed about one end of said cylindrical front mount; and a base mount disposed about said flanged central portion opposite to said cylindrical front mount, said base mount consisting of a partially cylindrical collar extending in an arc leaving a cutaway section, the method comprising the steps of:

aligning said antenna insert nut behind a hole in said device casing, said partially cylindrical collar extending above a first stud in said device casing;

inserting the cylindrical front mount into the hole in the device casing until said flanged central portion abuts an edge of said hole; and rotating the antenna insert nut until the partially cylindrical collar abuts said first stud on a side opposite said flanged central portion.

2. The method of claim 1, wherein said rotating step continues until rotation of said antenna insert nut is stopped by a second stud, said second stud being disposed in a plane between said first stud and said hole.

3. The method of claim 2, further comprising the step of adding a circuit board over said cylindrical collar.

4. The method of claim 1, further comprising the step of adding a contact clip to said low profile antenna insert nut.

5. The method of claim 4, further comprising the step of adding a circuit board over said cylindrical collar, said circuit board making electrical contact with said contact clip.

6. The method of claim 5, wherein, after installation, said circuit board and contact clip prevent rotation of said antenna insert nut.

7. A device casing of a compact device adapted to receive a low profile antenna insert nut, the low profile antenna insert nut having a cylindrical front mount with a round outer surface, a flanged central portion disposed about one end of said cylindrical front mount; and a base mount disposed about said flanged central portion opposite to said cylindrical front mount, said base mount consisting of a partially cylindrical collar extending in an arc leaving a cutaway section, said device casing comprising:

a hole about a first end of said device casing, said hole sized to rotatably accommodate the smooth outer surface of the cylindrical front mount of the antenna insert nut and to allow the flanged central portion to abut a periphery of said hole;

a first stud disposed rearwardly of said hole, said first stud positioned to abut a side of said base mount and to prevent said base mount from rotating beyond said stud; and a second stud disposed rearwardly of said hole, said second stud positioned to abut an end of said base mount and to prevent said base mount from moving rearwardly when said base mount abuts said stud.

8. The device casing of claim 7, wherein the compact device is a mobile device.

9. The device casing of claim 8, further comprising means for installing a printed circuit board.

* * * * *

UNITED STATES PATENT AND TRADEMARK OFFICE

CERTIFICATE OF CORRECTION

PATENT NO. : 7,403,163 B2
APPLICATION NO. : 11/671211
DATED : July 22, 2008
INVENTOR(S) : Timothy H. Kyowski It is certified that error appears in the above-identified patent and that said Letters Patent is hereby corrected as shown below:

Title Page of Patent, beneath (63), the foreign application priority data is missing "(30) Foreign Application Priority Data Nov. 29, 2002 (CA) .....2413459

Publication Classification"

Signed and Sealed this

First Day of September, 2009

David J. Kappos

David J. Kappos
*Director of the United States Patent and Trademark Office*